United States Patent [19]

Nakanishi et al.

[11] Patent Number: 4,678,551

[45] Date of Patent: Jul. 7, 1987

[54] PROCESS FOR PRODUCING AN ALUMINUM SUPPORT FOR A LITHOGRAPHIC PRINTING PLATE

[75] Inventors: Haruo Nakanishi; Hirokazu Sakaki; Toru Yamazaki; Yoshio Okishi, all of Shizuoka, Japan

[73] Assignee: Fuji Photo Film Co., Ltd., Kanagawa, Japan

[21] Appl. No.: 786,023

[22] Filed: Oct. 10, 1985

[30] Foreign Application Priority Data

Oct. 11, 1984 [JP] Japan ..... 59-212916
Oct. 11, 1984 [JP] Japan ..... 59-212917

[51] Int. Cl.[4] ..... C25F 3/04
[52] U.S. Cl. ..... 204/129.75; 156/665
[58] Field of Search ..... 204/129.75; 156/665

[56] References Cited

U.S. PATENT DOCUMENTS 4,547,274 10/1985 Ohashi ..... 204/129.4
4,584,067 4/1986 Hutchins ..... 204/33

*Primary Examiner*—T. M. Tufariello
*Attorney, Agent, or Firm*—Sughrue, Mion, Zinn, Macpeak, and Seas

[57] ABSTRACT

A process for producing an aluminum support for a lithographic printing plate, comprising chemical graining of an aluminum plate with an etching solution, is disclosed. The etching solution contains a mineral acid and an unsaturated concentration aluminum salt of a mineral acid. The printing plate produced from the support exhibits high printing durability and excellent performance in preventing stains in non-image areas.

14 Claims, 3 Drawing Figures

PROCESS FOR PRODUCING AN ALUMINUM SUPPORT FOR A LITHOGRAPHIC PRINTING PLATE

FIELD OF THE INVENTION

This invention relates to a process for producing a support for a lithographic printing plate, and more particularly, to a process for producing an aluminum support for a lithographic printing plate comprising chemical graining of an aluminum plate.

BACKGROUND OF THE INVENTION

Aluminum plates have conventionally been used as supports for lithographic printing plates. In order to obtain satisfactory adhesiveness of a light-sensitive layer to an aluminum support, and to impart a water retention property to non-image areas, the aluminum plate is required to be subjected to the so-called graining, i.e., a surface treatment for roughening the surface. The graining is an important step in the production of lithographic printing plates, since it has great influences on applicability of a support to a plate making process and on printing durability (press life) of the resulting printing plate in off-set printing.

Known processes for graining include mechanical graining processes, such as sandblasting, ball graining, wire graining, brush graining with a nylon brush and an abrasive-water slurry, etc.; a chemical graining process comprising etching a special aluminum alloy sheet with an alkali etching solution as disclosed in Japanese Patent Application (OPI) No. 61304/76 (the term "OPI" herein used means "unexamined published application"); a chemical graining process comprising etching a general aluminum plate (e.g., grade 1100) with a saturated aqueous solution of an aluminum salt of a mineral acid as disclosed in Japanese Patent Application (OPI) No. 31187/80, corresponding to U.S. Pat. No. 4,201,836; an electrochemical graining process as disclosed in Japanese Patent Application (OPI) Nos. 146234/79 and 28123/73; a combination of a mechanical graining process and an electrochemical graining process as disclosed in Japanese Patent Application (OPI) No. 123204/78; and a combination of a mechanical graining process and a chemical graining process using a saturated aqueous solution of an aluminum salt of a mineral acid as described in Japanese Patent Application (OPI) No. 55291/81 corresponding to U.S. Pat. No. 4,242,417. However, each of these conventional techniques has respective disadvantages as set forth below.

In the case of ball graining, which is a typical process for mechanical graining, there are problems in that high skills are required for selection of the kind of materials of balls and the kind of abrasives and for control of water in carrying out abrasion, and the like, and it is difficult to conduct the operations in a continuous production. In the case of wire graining, the roughness of the resulting aluminum plate is non-uniform. Brush graining, that is an improvement over these graining processes, generally provides only simple and shallow roughness, and the resulting printing plate has a short press life. Further, traces of a rotating brush unfavorably remain on the surface, the roughness undergoes orientation of the rotating brush, or stains are apt to be formed in non-image areas.

The chemical graining process disclosed in Japanese Patent Application (OPI) No. 61304/76 requires use of an aluminum alloy plate containing from 1.6 to 2.5% of manganese, and has, therefore, the disadvantage of difficulty in obtaining raw materials, and the disadvantage of formation of stains on prints, depending on printing conditions.

The aluminum plate having been chemically grained by etching with a saturated aqueous solution of an aluminum salt of a mineral acid as disclosed in Japanese Patent Application (OPI) No. 31187/80, corresponding to U.S. Pat. No. 4,201,836 was found to provide a lithographic printing plate having only short press life.

The electrochemical graining process is effective to form uniform roughness having a large average surface roughness, as compared with conventional mechanical graining processes, such as ball graining, brush graining, etc., by selecting proper electrolysis conditions. However, this process has a disadvantage of extremely narrow ranges of allowable conditions. More specifically, products having uniform performance properties with a narrow scatter can easily be obtained when various electrical conditions, such as the composition and temperature of an electrolytic solution, current density, and the like are maintained constant. However, since these electrolysis conditions are strictly limited, it is extremely difficult to carry out minute control of these conditions within appropriate ranges. Moreover, when surface roughening of the aluminum plate is effected only by electrochemical graining, there arises an economic problem in view of the high consumption of electric power which results in a larger proportion of electric power in the manufacturing costs.

Further, according to the combined process of brush graining and electrochemical graining as taught in Japanese Patent Application (OPI) No. 123204/78 and the combined process of brush graining and chemical graining as disclosed in Japanese Patent Application (OPI) No. 55291/81, corresponding to U.S. Pat. No. 4,242,417, it is possible to obtain a uniform surface roughness free from orientation and to minimize the consumption of electric power. There are problems, however, that brush graining with the same brush for a long period of time results in the failure of securing constant quality due to the wear of the brush used and that the operation should be suspended each time the brush has worn to a given extent, thus interfering with continuous production. In addition, stains are readily formed in the non-image areas presumably because of outlasting influences of brush graining.

SUMMARY OF THE INVENTION

Accordingly, an object of this invention is to provide a process for producing an aluminum support for a lithographic printing plate having a uniform surface roughness with relative ease and at high productivity in a continuous system for a prolonged period of time without requiring any special aluminum alloy.

Another object of this invention is to provide an aluminum support for a lithographic printing plate which has excellent press life, and the non-image areas which are less susceptible to stain formation.

As a result of extensive and intensive studies, it has now been found that the above objects can be accomplished by subjecting at least one side of an aluminum plate to etching with an aqueous solution containing a mineral acid and an unsaturation concentration of aluminum salt of a mineral acid.

That is, the present invention relates to a process for producing an aluminum support for a lithographic printing plate, comprising a chemical graining step using an etching solution, wherein the etching solution is an aqueous solution containing a mineral acid and an unsaturation concentration of aluminum salt of a mineral acid.

The present invention further relates to a process for producing an aluminum support for a lithographic printing plate which comprises a combination of the above-described chemical graining step and an anodic oxidation step or an electrochemical graining step or a combination of the above-described chemical graining step, an electrochemical graining step and an anodic oxidation step in the sequence.

A preferred feature of this invention resides in that the etching solution used in the above-described chemical graining step contains an aluminum salt of a mineral acid in concentrations of from 40 to 95% by weight with respect to a saturation concentration.

BRIEF DESCRIPTION OF DRAWING

FIG. 1(*a*) is a sine wave; FIG. 1(*b*) is a square wave; and FIG. 1(*c*) is a trapezoidal wave. In FIG. 1, (VA) and (VC) indicate an anode time electric voltage and a cathode time electric voltage, respectively, and (tA) and (tC) indicate an anode time and a cathode time, respectively.

DETAILED DESCRIPTION OF THE INVENTION

Figure 1A:
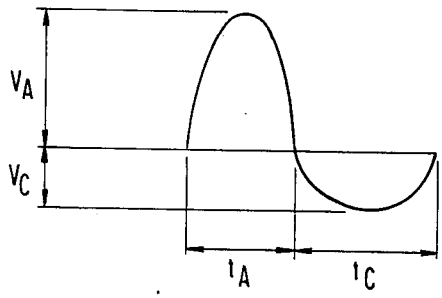
FIG. 1 shows voltage waves of electric current obtained as alternating current waves.

The aluminum plate which can be used in the present invention includes a pure aluminum plate and an aluminum alloy plate, and can be produced, e.g., by general continuous casting. The aluminum alloy may be composed of aluminum as a main component and other metals, e.g., silicon, copper, manganese, magnesium, chromium, zinc, lead, bismuth, nickel, etc. These alloys may contain slight amounts of iron and titanium, and, in addition, negligible amounts of other impurities.

The aluminum plate may be cleaned for removing fats and oils, rust, dust, and the like attached to its surface before it is subjected to chemical graining in accordance with the present invention. The cleaning treatment can be carried out by, for example, solvent degreasing using trichlene, etc. or alkali etching using sodium hydroxide, potassium hydroxide, etc. In the latter case, the alkali-etched aluminum plate is usually subjected to a desmutting treatment for removing smut resulting from the alkali etching by, for example, immersing it in from 10 to 30% nitric acid.

The aluminum plate, if necessary after having been subjected to the above-described cleaning treatment, is then chemically grained using an etching aqueous solution containing a mineral acid and an aluminum salt thereof.

The mineral acid which can be used includes hydrochloric acid, sulfuric acid, phosphoric acid, boric acid, nitric acid, etc., with hydrochloric acid being particularly preferred. The aluminum salt of a mineral acid suitably includes aluminum salts of the above-recited mineral acids, with aluminum chloride being particularly preferred.

The etching aqueous solution to be used in the chemical graining step preferably contains from 6 to 20% by weight, and more preferably from 10 to 15% by weight, of a mineral acid. If the mineral acid concentration is less than 6% by weight, the graining speed tends to suddenly fall. On the other hand, if the concentration exceeds 20% by weight, corrosion with the acid proceeds with violence to dissolve too large an amount of aluminum, resulting in reduction of thickness of the aluminum plate and increase of load for handling the discharge. Accordingly, a preferred concentration of the mineral acid falls within a range of from 10 to 15% by weight.

The aluminum salt of a mineral acid (hereinafter simply referred to as "aluminum salt") can be used in concentrations widely ranging from about 40% by weight up to a saturation concentration. However, a saturation concentration of an aluminum salt is not recommended since it becomes difficult to obtain a lithographic printing plate having long press life. Therefore, the concentration of the aluminum salt preferably ranges from 40 to 95% by weight, and more preferably from 70 to 95% by weight, with respect to the saturation concentration. Concentrations lower than 40% by weight based on the saturation concentration are less favorable since corrosion tends to proceed excessively to dissolve aluminum too much, and the center-line roughness becomes as high as 1.3 μm or more, tending to render it less suitable or even unsuitable as a lithographic printing plate. On the other hand, at concentrations higher than 95% by weight with respect to a saturation concentration, the press life of the resulting lithographic printing plate is abruptly reduced.

Japanese Patent Application (OPI) No. 31187/80, corresponding to U.S. Pat. No. 4,201,836 discloses a process of chemically graining a surface of an aluminum plate with a saturated aqueous solution of an aluminum salt of a mineral acid, e.g., aluminum chloride, wherein importance is attached to the use of an etching solution containing aluminum chloride at a saturation concentration. However, investigations by the present inventors revealed an unexpected result that a lithographic printing plate produced from such an aluminum plate having been chemically grained with a saturated aqueous solution of aluminum chloride shows a press life reaching only 50% at most of that obtained by a lithographic printing plate produced from an aluminum plate according to the present invention. Hence, it is very important that the concentration of the aluminum salt in the etching solution to be used in the present invention be adjusted within a range of from 40 to 95% by weight with respect to a saturation concentration.

In the present invention, chemical graining with the above-described etching solution is preferably carried out so that an average center-line roughness (Ra) of the surface of the etched aluminum plate may range from 0.3 to 1.3 μm. The average center-line roughness is measured according to a method of JIS-B0601-1970. As the average center-line roughness becomes smaller than 0.3 μm, water retention property of the resulting lithographic printing plate is reduced; and, as it becomes greater than 1.3 μm, stains are apt to be formed on the non-image areas of the lithographic printing plate. Specific conditions for achieving such a preferred surface roughness are advantageously chosen from a range of from 20° to 100° C. in temperature and a range of from 10 to 120 seconds in treating time. Etching can be effected by any of known techniques for contacting an aluminum plate with an etching solution, such as spray etching and immersion etching.

Since the thus chemically grained aluminum plate has smut deposited thereon, it is preferable to subject the aluminum plate to a desmutting treatment for removing the smut. The desmutting treatment can be carried out by contacting the surface of an aluminum plate with an acid or alkali aqueous solution by, for example, spraying or immersion. The acid to be used in the desmut treatment includes phosphoric acid, sulfuric acid, chromic acid, etc., and the alkali to be used includes sodium hydroxide, potassium hydroxide, sodium tertiary phosphate, potassium tertiary phosphate, sodium aluminate, sodium metasilicate, sodium carbonate, etc. Of these, the alkali aqueous solutions are preferred in view of rapidity of treatment. In general, desmutting treatment is conducted by using a 0.5 to 40 wt % aqueous solution of these acids or alkalis at a temperature of from 20° to 10° C. for a period of from 1 to 300 seconds. When an alkali aqueous solution is employed, the surface of the aluminum plate is eluted out to form alkali-insoluble residue on the surface. Such being the case, the insoluble residue can be removed by an additional treatment with phosphoric acid, nitric acid, sulfuric acid or chromic acid or a mixed acid composed of two or more of these acids.

The aluminum plate thus treated can be used as a support for a lithographic printing plate as such or after being subjected to a surface treatment for rendering it hydrophilic. However, in the cases where the aluminum plate is to be employed for the production of lithographic printing plates having higher printing durability, the aluminum plate thus produced is subsequently subjected to anodic oxidation.

Anodic oxidation can be carried out by conventionally employed processes. Specifically, an anodic oxidation film can be formed on the surface of an aluminum support by applying direct or alternating electric current using the aluminum plate as an anode in an aqueous or non-aqueous solution of sulfuric acid, phosphoric acid, chromic acid, oxalic acid, sulfamic acid, benzenesulfonic acid, etc., or a combination of two or more thereof as an electrolyte.

The processing conditions for anodic oxidation are not strictly limited, and vary depending on the electrolyte used, but it is generally suitable to employ conditions of a concentration of the electrolyte of from 1 to 80% by weight, a liquid temperature of from 5° to 70° C., a current density of from 0.5 to 60 amperes/dm$^2$, an electric voltage of from 1 to 100 V, and an electrolysis time of from 10 seconds to 50 minutes.

In particular, anodic oxidation is preferably embodied by the method disclosed in British Pat. No. 1,412,768, in which a high current density is used in sulfuric acid, or the method disclosed in U.S. Pat. No. 3,511,661 in which phosphoric acid is used as an electrolytic bath.

The anodically oxidized aluminum plate can further be treated with an alkali metal silicate, e.g., sodium silicate, by immersion or the like as described in U.S. Pat. No. 3,181,461 or with polyvinylsulfonic acid as described in U.S. Pat. No. 4,153,461; or a subbing layer comprising hydrophilic cellulose, e.g., carboxymethyl cellulose, containing a water-soluble metal salt, e.g., zinc acetate, can be provided as described in U.S. Pat. No. 3,860,426.

The aluminum plate having been subjected to chemical graining as described above can further be subjected to electrochemical graining. Electrochemical graining can preferably be carried out using alternating current in an acidic electrolytic solution.

The term "alternating current" herein used means a wave obtained by alternately exchanging positive polarity and negative polarity, and includes not only single-phase alternating current and three-phase alternating current of sine wave like commercial alternating current, but also electric current of square wave or trapezoidal wave. These alternating current waves will hereinafter be referred to as alternating wave current all-inclusively.

Figure 1B:
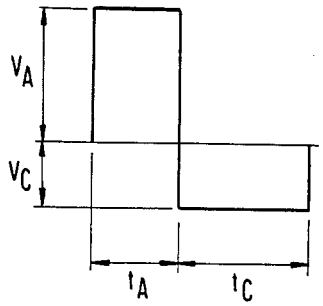
Figure 1C:
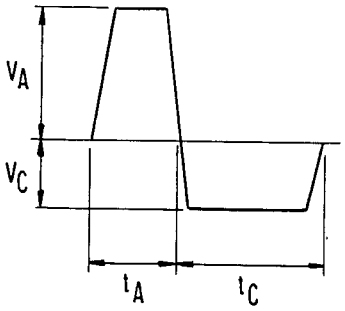

In a preferred embodiment of the present invention, asymmetric alternating wave current is applied to an aluminum plate in an acidic electrolytic solution so that the quantity of electricity at the anode time (QA) may be greater than that at the cathode time (QC). A preferred ratio of QC/QA is from 0.3 to 0.95. In this case, it is desirable that alternating wave current is applied to the aluminum plate so that the QA is greater than QC at such a voltage that the anode time electric voltage is greater than the cathode time electic voltage, as described in U.S. Pat. No. 4,087,341. FIG. 1 illustrates waves of alternating wave current. FIGS. 1(*a*), 1(*b*) and 1(*c*) each shows sine wave, square wave and trapezoidal wave, respectively. Any of these waves can be used in the present invention.

The voltage applied to the aluminum plate is from about 1 to about 50 V, and preferably from 2 to 30 V; the current density is from about 10 to about 100 amperes/dm$^2$, and preferably from 10 to 80 amperes/dm$^2$; and the quantity of electricity at the anode is from about 10 to about 3,000coulomb/dm$^2$, and preferably 50 to 1800 coulomb/dm$^2$. The temperature of the electrolytic bath is selected from about 10° C. to about 50° C., and preferably from 15° to 50° C.

The acidic electrolytic solution preferably includes hydrochloric acid, nitric acid and a combination thereof. The concentration of the acid is suitably selected from about 0.5 to 5% by weight. The electrolytic solution may contain, if desired, a corrosion inhibitor or stabilizer, such as a hydrochloride, a nitrate, monoamines, diamines, aldehydes, phosphoric acid, chromic acid, boric acid, etc.

Since electrochemical graining generates smut on the surface of the aluminum plate, the plate is usually subjected to desmut treatment after washing with water to remove the smut. The desmut treatment can be effected by treating the surface of the aluminum plate with an acid or alkali aqueous solution by a known technique, for example, immersion. The acid used includes phosphoric acid, sulfuric acid, chromic acid, etc., and the alkali includes those enumerated for the desmut treatment after the chemical graining step as described before. In particular, desmut treatment is preferably achieved by the method described in Japanese Patent Application (OPI) No. 12739/78 in which an aluminum plate is brought into contact with 15 to 65 wt % sulfuric acid solution at a temperature of from 50° to 90° C., or by the alkali-etching method described in Japanese Patent Publication No. 28123/73.

In the case of the latter desmut treatment by alkali-etching, the aluminum plate is preferably subjected to an additional treatment with phosphoric acid, nitric acid, sulfuric acid, chromic acid or a mixed acid composed of two or more of these acids for the purpose of removing any alkali-insoluble matter on the surface and neutralizing the alkali.

The thus treated aluminum plate can be used as a support for lithographic printing plates as such, or, if desired, after being subjected to an additional chemical treatment. However, if higher printing durability of a lithographic printing plate is demanded, the aluminum plate thus produced is further subjected to anodic oxidation. In this case, the anodic oxidation can be carried out in the same manner as described above with respect to the anodic oxidation step after the chemical graining step.

Onto the support for lithographic printing plates according to the present invention can be provided a conventionally known light-sensitive layer to produce a so-called presensitized printing plate (hereinafter also referred to as a PS plate). Lithographic printing plates obtained by plate-making processing of a PS plate possess excellent performance properties.

Compositions for the above-described light-sensitive layer include (a) a composition comprising a diazo resin and a binder, (b) a composition comprising o-naphthoquinone-diazide compound, (c) a composition comprising an azide compound and a binder, (d) a photopolymerizable composition comprising an ethylenically unsaturated monomer, a photopolymerization initiator, and a high polymeric binder, (e) a composition comprising a photocrosslinkable polymer having a —CH=CH—CO— group in its main chain or side chain, and the like. Details of these light-sensitive compositions are described e.g., in U.S. Pat. No. 4,238,560. The light-sensitive layer is usually coated on the support according to the present invention to a coverage of from about 0.1 to about 7 g/m$^2$, and preferably from 0.5 to 4 g/m$^2$.

According to the process of the present invention, a support for lithographic printing plates which has satisfactory surface roughness can be produced without using any special aluminum alloy, and chemical graining can be completed in a short period of time to form uniform roughness on the surface of an aluminum plate.

Further, a lithographic printing plate produced from the support according to the present invention exhibits excellent press life as compared with those produced by conventional chemical graining or mechanical graining.

Furthermore, because the process in accordance with the present invention does not involve brush graining, various disadvantages associated with brush graining, such as non-uniform roughness due to wear of a brush, are eliminated. In the present invention, all what is required is maintenance of the appropriate composition of the processing solution for chemical graining, and, therefore, continuous productivity for an extended period of time can be ensured.

Moreover, the present invention is advantageous in that a lithographic printing plate less subjected to stains in the non-image areas can be produced, as compared with those produced from supports that are prepared by a combination of brush graining and electrochemical graining as described in Japanese Patent Application (OPI) No. 123204/78 or a combination of brush graining and chemical graining as disclosed in Japanese Patent Application (OPI) No. 55291/81, corresponding to U.S. Pat. No. 4,242,417.

The present invention will now be illustrated in greater detail with reference to the following examples and comparative examples, but it should be understood that these examples do not limit the invention. In these examples, all percents are by weight unless otherwise indicated.

EXAMPLES 1 TO 8

A 0.24 mm thick aluminum plate (JIS A1050) was chemically grained by immersing in an aqueous solution containing hydrochloric acid and aluminum chloride in various concentrations shown in Table 1 at a temperature of 40° C. or 70° C. so as to form an average center-line roughness of 0.55 μm. The aluminum plate was then immersed in a 10% sodium hydroxide aqueous solution at 50° C. for 10 seconds to remove the smut which resulted from the chemical graining. The plate was washed with 20% nitric acid to neutralize the alkali and to remove the alkali-insoluble residue, followed by washing with water. The aluminum plate was subsequently subjected to anodic oxidation in an 18% sulfuric acid aqueous solution to form 1.5 g/m$^2$ of an anodic oxidation film, washed with water and dried to prepare Supports 1 to 8.

Onto each of the resulting supports was coated a light-sensitive composition having the following formulation, followed by drying to form a light-sensitive layer having a dry weight of 1.5 g/m$^2$.

| Light-Sensitive Composition: | |
|---|---|
| Ester compound of naphthoquinone-1,2-diazido-5-sulfonyl chloride and pyrogallol-acetone resin (as described in Example 1 of U.S. Pat. No. 3,635,709) | 0.75 g |
| Cresol-novolak resin | 2.00 g |
| Tetrahydrophthalic anhydride | 0.15 g |
| Oil Blue #603 (oil-soluble blue dye manufactured by Orient Chemical K.K.) | 0.04 g |
| o-Naphthoquinonediazido-4-sulfonyl chloride | 0.04 g |
| Ethylene dichloride | 16 g |
| 2-Methoxyethyl acetate | 12 g |

The presensitized lithographic printing plate precursor thus prepared was exposed to light emitted from a 2 KW metal halide lamp placed 1 m away for 60 seconds through a positive transparent pattern, developed with a developing solution having the following formulation (25° C.), and gummed up, by coating an aqueous solution of gum arabic and subsequently drying.

| Developing Solution Formulation: | |
|---|---|
| Sodium metasilicate | 90 g |
| JIS No. 3 sodium silicate | 4 g |
| Water | 1000 g |

The resulting printing plate was mounted on a printing press KOR (made by Herderberg Co.) and printed using water as a dampening agent. The results obtained are shown in Table 1 below.

COMPARATIVE EXAMPLES 1 AND 2

Comparative Support 1 or 2 was produced in the same manner as described in Example 1 or 4, respectively, except for using an aqueous solution containing 10% of hydrochloric acid and a saturation concentration of aluminum chloride. A lithographic printing plate was produced in the same manner as in Example 1 but using Comparative Support 1 or 2, and was used for printing in a usual manner. The results obtained are shown in Table 1 below.

COMPARATIVE EXAMPLE 3

A 0.24 mm thick aluminum plate was mechanically grained with a rotating nylon brush in a pumice-water slurry having a particle size of 400 mesh, to form an average center-line roughness of 0.55 μm. The thus grained aluminum plate was soaked in a 10% aqueous solution of sodium hydroxide at 50° C. for 60 seconds to remove the abrasive, aluminum smut, etc., adhered to the aluminum surface during the graining, washed with running water, neutralized with 20% nitric acid, and washed with water. The aluminum plate was then anodically oxidized in a 18% sulfuric acid aqueous solution to form 1.5 g/m$^2$ of an anodic oxidation film, followed by washing with water and drying to prepare Comparative Support 3. A lithographic printing plate was produced in the same manner as in Example 1 but using Comparative Support 3, and was used for printing in the same manner. The results obtained are shown in Table 1 below.

TABLE 1

| Example No. | Etching Solution: Concentration of HCl (wt %) | Etching Solution: Concentration of $AlCl_3$ with Respect to Saturation Concentration (wt %) | Etching Solution: Temperature (°C.) | Press Life | Stains in Non-Image Areas* |
|---|---|---|---|---|---|
| Support 1 | 10 | 40 | 70 | 40,000 prints | B |
| Support 2 | 10 | 60 | 70 | 40,000 prints | A |
| Support 3 | 10 | 85 | 70 | 40,000 prints | A |
| Support 4 | 10 | 95 | 40 | 40,000 prints | A |
| Support 5 | 15 | 40 | 70 | 40,000 prints | B |
| Support 6 | 60 | 60 | 70 | 40,000 prints | A |
| Support 7 | 15 | 85 | 70 | 40,000 prints | A |
| Support 8 | 15 | 95 | 40 | 40,000 prints | A |
| Support 1 (Comparative) | 10 | 100 | 70 | 20,000 prints | A |
| Support 2 (Comparative) | 10 | 100 | 40 | 20,000 prints | A |
| Support 3 (Comparative) | | mechanically grained | | 30,000 prints | B |

Note:
*A . . . No stain was formed even under varying an amount of dampening water provided on a printing press.
B . . . Stains were formed with a slight variation of amount of dampening water provided on a printing press It can be seen from the results shown in Table 1 above that Supports 1 to 8 according to the present invention are superior to the Comparative Supports 1 to 3 in terms both of prevention of stains in non-image areas and press life. It is particularly noted that Comparative Support 1 or 2, which were chemically grained with an etching solution containing aluminum chloride at a saturation concentration, exhibited seriously reduced press life.

EXAMPLE 9

A 0.24 mm thick aluminum plate (JIS A1050) was chemically grained by soaking in an aqueous solution containing 10% of hydrochloric acid and 15% of aluminum chloride which corresponded to a concentration of 65% with respect to a saturation concentration, at 70° C. to form a centerline roughness of 0.55 μm. The aluminum plate was immersed in a 10% aqueous solution of sodium hydroxide at 50° C. for 10 seconds to remove the smut produced during the chemical graining, washed with 20% nitric acid to remove any insoluble matter, and washed with water. The aluminum plate was then anodically oxidized in an 18% sulfuric acid aqueous solution to form 1.5 g/m$^2$ of an anodic oxidation film, washed with water, immersed in a 2% sodium silicate aqueous solution at 70° C. for 1 minute, washed with water and dried to prepare Support 9.

A light-sensitive composition having the following formulation was coated on the resulting support and dried to form a light-sensitive layer having a dry weight of 2.0 g/m$^2$.

| Light-Sensitive Composition: | |
|---|---|
| N—(4-Hydroxyphenyl)methacrylamide/2-hydroxyethyl methacrylate/acrylonitrile/methyl methacrylate/methacrylic acid copolymer (15/10/30/38/7 by molar ratio; average molecular weight: 60,000) | 5.0 g |
| Hexafluorophosphate of a condensate of 4-diazophenylamine and formaldehyde | 0.5 g |
| Phosphorous acid | 0.05 g |
| Victoria Pure Blue BOH (manufactured by Hodogaya Chemical K.K.) | 0.1 g |
| 2-Methoxyethanol | 100 g |

The resulting presensitized lithographic printing plate precursor was exposed to light emitted from a 3 KW metal halide lamp from a distance of 1 m for 50 seconds through a negative transparent pattern in a vacuum printer, developed with a developing solution having the following formulation and gummed up with a gum arbic aqueous solution to produce a lithographic printing plate.

| Developing Solution Formulation: | |
|---|---|
| Sodium sulfite | 5 g |
| Benzyl alcohol | 30 g |
| Sodium carbonate | 5 g |
| Sodium isopropylnaphthalenesulfonate | 12 g |
| Pure water | 1000 g |

The resulting printing plate was used for printing in the aforesaid manner, and the results obtained are shown in Table 2 below.

COMPARATIVE EXAMPLE 4

A 0.24 mm thick aluminum plate (JIS A1050) was mechanically grained with a rotating nylon brush in a pumice-water slurry having a particle size of 400 mesh. The grained aluminum plate was immersed in a 10% aqueous solution of sodium hydroxide at 50° C. for 60 seconds to uniformalize the surface by removing the abrasive, aluminum smut, etc., which had been adhered to the aluminum surface during the mechanical graining, followed by washing with water. Then, the aluminum plate was washed with 20% nitric acid for neutralization, followed by washing with water. The aluminum plate was then anodically oxidized in an 18% sulfuric acid aqueous solution to form 1.5 g/m$^2$ of an anodic oxidation film. After washing with water, the anodically oxidized aluminum plate was immersed in a 2% aqueous solution of sodium silicate at 70° C. for 1 minute, washed with water and dried to prepare Comparative Support 4. A lithographic printing plate was produced in the same manner as in Example 9, except using Comparative Support 4, and was used for printing in the aforesaid manner. The results obtained are shown in Table 2 below.

TABLE 2

| | Example 9 | Comparative Example 4 |
|---|---|---|
| Support | 9 | Comparative Support 4 |
| Center-line average roughness (μm) | 0.55 | 0.55 |
| Press life | 100,000 prints | 100,000 prints |
| Stains in non-image areas* | A | B |

Note:
*A No stain was formed even under varying amount of dampening water provided on a printing press
B Stains were formed with a slight variation of amount of dampening water It is apparent from the results shown in Table 2 that the support according to the present invention exhibits satisfactory performance properties in terms of prevention of stains in non-image areas as compared with the comparative support.

EXAMPLE 10

A 0.2 mm thick aluminum plate (JIS A1050) was chemically grained by immersion in an aqueous solution containing 10% of hydrochloric acid and 80%, based on a saturation concentration, of aluminum chloride at 65° C. so as to result in a center-line average roughness of 0.55 μm. The plate was then soaked in a 10% sodium hydroxide aqueous solution at 50° C. for 10 seconds to remove the smut formed during the chemical graining, and then neutralized and washed with 20% nitric acid to remove any insoluble matter, followed by thoroughly washing with water. Thereafter, the aluminum plate was immersed in a 1.5% sodium silicate aqueous solution at 70° C. for 30 seconds, washed with water and dried to prepare Support 10.

A light-sensitive composition of the following formulation was coated on Support 10 and dried to form a light-sensitive layer having a dry weight of 1.5 g/m$^2$.

| Light-Sensitive Composition: | |
|---|---|
| Ester compound of naphthoquinone-1,2-diazido-5-sulfonyl chloride and pyrogallol-acetone resin (the same as described in Example 1 of U.S. Pat. No. 3,635,709) | 0.75 g |
| Cresol-novolak resin | 2.00 g |
| Tetrahydrophthalic anhydride | 0.15 g |
| Oil Blue #603 (manufactured by Orient Chemical K.K.) | 0.04 g |
| Orthonaphthoquinonediazido-4-sulfonyl chloride | 0.04 g |
| Ethylene dichloride | 16 g |
| 2-Methoxyethyl acetate | 12 g |

The resulting presensitized lithographic printing plate precursor was exposed to light for 60 seconds using a 2 KW metal halide lamp placed 1 m away through a positive transparent pattern, developed with a developing solution having the following formulation at 25° C., and gummed up.

| Developing Solution Formulation: | |
|---|---|
| Sodium metasilicate | 90 g |
| JIS No. 3 sodium silicate | 4 g |
| Water | 1000 g |

The thus produced printing plate was used for printing to determine printing durability (press life) and stains in the non-image areas. The results obtained are shown in Table 3 below.

COMPARATIVE EXAMPLE 5

Comparative Support 5 was prepared in the same manner as in Example 3 except that an aqueous solution containing 10% of hydrochloric acid and a saturation concentration of aluminum chloride was used as an etching solution for the chemical graining. A lithographic printing plate was produced from Comparative Support 5 in the same manner as in Example 10. Printing was carried out using the resulting printing plate, and the results obtained are shown in Table 3 below.

TABLE 3

| | Example 10 | Comparative Example 5 |
|---|---|---|
| Support | 10 | Comparative Support 5 |
| Center-line average roughness (μm) | 0.55 | 0.55 |
| Press life | 20,000 prints | 10,000 prints |
| Stains in non-image areas* | A | B |

Note:
*A No stains were formed even under varying amount of dampening water provided on a printing press.

It can be seen from the results of Table 3 that the support according to the present invention is superior to the comparative support in terms of press life.

EXAMPLE 11

A 0.24 mm thick aluminum plate (JIS A1050) was chemically grained by immersion in an aqueous solution containing 10% of hydrochloric acid and 85%, with respect to a saturation concentration, of aluminum chloride (corresponding to about 20% based on the total weight of the aqueous solution) at 70° C. so as to result in an average center-line roughness of 0.55 μm. The aluminum plate was immersed in a 10% aqueous solution of sodium hydroxide at 50° C. for 10 seconds to remove the smut formed by the chemical graining. The plate was neutralized and washed with 20% nitric acid to remove the insoluble residue on the surface, followed by washing with water.

Thereafter, the aluminum plate was subjected to electrolysis using a nitric acid aqueous solution having a concentration of 7 g/l as an electrolytic solution and alternating wave current shown in FIG. 1(*b*) under conditions of a frequency of 60 Hz, VA=25 V, VC=13 V, an anodic time electric quantity QA=176 coulomb/dm$^2$, and a cathodic time electric quantity QC=125 coulomb/dm$^2$ (QC/QA=0.71). The plate was then soaked in a 10% aqueous solution of sodium hydroxide at 50° C. for 10 seconds to remove the smut formed by the electrochemical graining. Thereafter, an anodic oxidation film having a thickness of 1.5 g/m$^2$ was formed in a 18% sulfuric acid aqueous solution, followed by washing with water. The plate was soaked in a 2% sodium silicate aqueous solution at 70° C. for 1 minute, washed with water and dried to prepare Support 11.

A light-sensitive composition having the following formulation was coated on the thus treated aluminum plate to a thickness of 2.0 g/m$^2$ on a dry basis, followed by drying to obtain a presensitized lithographic printing plate precursor.

| Light-Sensitive Composition: | |
|---|---|
| N—(4-Hydroxyphenyl)methacrylamide/2-hydroxyethyl methacrylate/acrylonitrile/methyl methacrylate/methacrylic acid copolymer (15/10/30/38/7 by mol; average molecular weight: 60,000) | 5.0 g |
| Hexafluorophosphate of a condensate between 4-diazodiphenylamine and formaldehyde | 0.5 g |
| Phosphorous acid | 0.05 g |
| Victoria Pure Blue BOH (manufactured by Hodogaya Chemical Co., Ltd.) | 0.1 g |
| 2-Methoxyethanol | 100 g |

The resulting printing plate precursor was exposed to light emitted from a 3 KW metal halide lamp from a distance of 1 m for 50 seconds through a negative transparent pattern in a vacuum printing frame, developed with a developing solution of the following formulation and gummed up with a gum arabic aqueous solution to produce a lithographic printing plate.

| Developing Solution Formulation: | |
|---|---|
| Sodium sulfite | 5 g |
| Benzyl alcohol | 30 g |
| Sodium carbonate | 5 g |
| Sodium isopropylnaphthalenesulfonate | 12 g |
| Pure water | 1000 g |

The thus prepared lithographic printing plate was used for printing in the aforesaid manner, and the results obtained are shown in Table 4 below.

COMPARATIVE EXAMPLE 6

Comparative Support 6 was prepared in the same manner as in Example 11, except omitting the electrochemical graining, the subsequent immersion treatment with a sodium hydroxide aqueous solution, and the desmut treatment. A lithographic printing plate was produced in the same manner as in Example 11, except for using Comparative Support 6, and the printing plate was used for printing in the aforesaid manner. The results obtained are shown in Table 4 below.

EXAMPLE 12

Support 12 was prepared in the same manner as in Example 11, except using an aqueous solution containing 10% hydrochloric acid and a saturation concentration of aluminum chloride as a processing solution for the chemical graining. A lithographic printing plate was produced in the same manner as in Example 11, except using Support 12, and the resulting printing plate was used for printing in the aforesaid manner. The results obtained are shown in Table 4 below.

COMPARATIVE EXAMPLE 7

Comparative Support 7 was prepared in the same manner as in Example 12, except for omitting the electrochemical graining and the subsequent immersion treatment with a sodium hydroxide aqueous solution and the desmut treatment. A lithographic printing plate was produced in the same manner as in Example 11, except using Comparative Support 7, and the printing plate was used for printing in the aforesaid manner. The results obtained are shown in Table 4 below.

COMPARATIVE EXAMPLE 8

A 0.24 mm thick aluminum plate (JIS A1050) was mechanically grained with a rotating nylon brush while applying a pumice-water slurry having a particle size of 400 mesh so as to result in an average center-line roughness of 0.55 μm.

The thus mechanically grained aluminum plate was immersed in a 10% aqueous solution of sodium hydroxide at 50° C. for 60 seconds to remove the abrasive, aluminum smut, etc., which had been adhered onto the aluminum surface during the mechanical graining to uniformarize the surface, followed by washing with running water. The aluminum plate was then washed with 20% nitric acid for neutralization and removal of any insoluble residue on the surface, followed by washing with water. Thereafter, the plate was electrochemically grained in a nitric acid aqueous solution having a concentration of 7 g/l as an electrolytic solution using alternating wave current shown in FIG. 1(*b*). The electrolysis was carried out for 5 seconds under conditions of a frequency of 60 Hz, VA=25 V, VC=13 V, an anodic time electric quantity QA=176 coulomb/dm$^2$, and a cathodic time electric quantity QC=125 coulomb/dm$^2$ (QC/QA=0.71).

The aluminum plate was then immersed in a 10% sodium hydroxide aqueous solution at 50° C. for 10 seconds to remove the smut formed by the electrochemical graining. An anodic oxidation film having a thickness of 1.5 g/m$^2$ was formed in an 18% sulfuric acid aqueous solution, followed by washing with water. The plate was then immersed in a 2% sodium silicate aqueous solution at 70° C. for 1 minute, washed with water, and dried to prepare Comparative Support 8. A lithographic printing plate was produced in the same manner as in Example 11, except using Comparative Support 8, and the resulting printing plate was used for printing in an aforesaid manner. The results obtained are shown in Table 4 below.

COMPARATIVE EXAMPLE 9

A 0.24 mm thick aluminum plate (JIS A1050) was mechanically grained with a rotating nylon brush while applying a pumice-water slurry having a particle size of 400 mesh so as to form an average center-line roughness of 0.55 μm.

The thus mechanically grained aluminum plate was immersed in a 10% sodium hydroxide aqueous solution at 50° C. for 60 seconds to thereby remove the abrasive, aluminum smut, etc., that had been adhered onto the surface during the graining to uniformalize the surface, followed by washing with running water. Then, the aluminum plate was treated with 20% nitric acid for neutralization and removal of the insoluble residue on the surface. After washing with water, the aluminum plate was chemically grained using an aqueous solution containing 10% hydrochloric acid and a saturation concentration of aluminum chloride.

Thereafter, the aluminum plate was immersed in a 10% sodium hydroxide aqueous solution at 50° C. for 10 seconds to remove the smut formed by the chemical graining. The plate was further treated with 20% nitric acid for neutralization and removal of the insoluble residue on the surface, followed by washing with water. The plate was then subjected to anodic oxidation to form an anodic oxidation film having a thickness of 1.5 g/m$^2$. The plate was immersed in a 2% sodium silicate aqueous solution at 70° C. for 1 minute, washed with water and dried to prepare Comparative Support 9. A lithographic printing plate was produced in the same manner as in Example 1, except using Comparative Support 9, and the resulting printing plate was used for printing in the aforesaid manner. The results obtained are shown in Table 4 below.

It can be seen from all these considerations that only the supports according to the present invention can provide a lithographic printing plate which satisfies two requirements, i.e., high printing durability and excellent performance of preventing stains in non-image areas.

EXAMPLE 13

A 0.24 mm thick aluminum plate (JIS A1050) was chemically grained by immersion in an aqueous solution containing 15% of hydrochloric acid and 87%, with respect to a saturation concentration, of aluminum chloride (corresponding to about 15% based on the aqueous solution) at 70° C. so as to form a center-line average roughness of 0.55 μm.

TABLE 4

| | Example 11 | Comparative Example 6 | Example 12 | Comparative Example 7 | Comparative Example 8 | Comparative Example 9 |
|---|---|---|---|---|---|---|
| Support | 11 | Comparative Support 6 | 12 | Comparative Support 7 | Comparative Support 8 | Comparative Support 9 |
| Processing Solution in Chemical Graining | 10% of HCl, 85%* of $AlCl_3$ (ca. 20%)** | 10% of HCl, 85%* of $AlCl_3$ (ca. 20%) | 10% of HCl, saturation concn. of $AlCl_3$ | 10% of HCl, saturation concn. of $AlCl_3$ | not conducted | brush graining, followed by chemical graining; 10% of HCl, saturation concn. of $AlCl_3$ |
| Brush Graining | not conducted | not conducted | not conducted | not conducted | conducted | not conducted |
| Electrochemical Graining | conducted | not conducted | conducted | not conducted | conducted | not conducted |
| Light-Sensitive Layer | negative | negative | negative | negative | negative | negative |
| Stains in Non-Image Areas*** | A | A | A | A | B | B |
| Press Life | 100,000 prints | 80,000 prints | 60,000 prints | 40,000 prints | 100,000 prints | 60,000 prints |

Note:
*Concentration with respect to a saturation concentration
**Concentration based on the aqueous solution
***A . . . No stain was formed even under varying amount of dampening water provided on a printing press
B . . . Stains were formed with a slight variation of amount of dampening water The following understanding can be arrived at from the results shown in Table 4 above.

Support 11 prepared by a combination of chemical graining with an aqueous solution containing hydrochloric acid and aluminum chloride and electrochemical graining provides a lithographic printing plate having higher printing durability as compared with Comparative Support 6, which had been roughened only by chemical graining. The same tendency can be seen from comparison between Support 12 and Comparative Support 7.

Further, comparison between Example 11 and Example 12 reveals that a printing plate having higher printing durability can be obtained by using a processing solution for the chemical graining which contains aluminum chloride at a non-saturated concentration than that containing a saturation concentration of aluminum chloride.

Furthermore, it is proved by comparing Example 12 and Comparative Example 9 that a combination of chemical graining and electrochemical graining is superior to a combination of brush graining and chemical graining for producing a printing plate less susceptible to stain formation in the non-image areas.

It is still further proved, by comparing Example 11 and Comparative Example 8, that a combination of chemical graining and electrcchemical graining is superior to a combination of brush graining and electrochemical graining for providing a printing plate less susceptible to stain formation in the non-image areas.

The aluminum plate was immersed in a 10% aqueous sodium hydroxide solution at 50° C. for 10 seconds to effect surface etching to thereby remove the smut formed by the chemical graining. The aluminum plate was then electrolytically roughened in the same manner as in Example 11, followed by soaking in a 15% sulfuric acid aqueous solution at 50° C. for 3 minutes to remove the smut formed by the electrolytic roughening treatment. The plate was subsequently subjected to anodic oxidation in an 18% sulfuric acid aqueous solution to form 1.5 g/m$^2$ of an amount of anodic oxidation film, washed with water and dried to prepare Support 13.

A light-sensitive composition of the following formulation was applied onto the resulting support to form a light-sensitive layer to a thickness of 2.0 g/m$^2$ on a dry basis.

| Light-Sensitive Composition: | |
|---|---|
| Naphthoquinone-1,2-diazido(2)-5-sulfonic acid ester of acetone-pyrogallol resin (as prepared in Example 1 of U.S. Pat. No. 3,635,709) | 5 g |
| t-Butylphenol-formaldehyde resin | 0.5 g |
| Cresol-formaldehyde resin | 5 g |
| Methyl ethyl ketone | 50 g |
| Cyclohexanone | 40 g |

The thus prepared presensitized lithographic printing plate precursor was exposed to light emitted from a 3 KW metal halide lamp for 30 seconds through a positive transparent pattern in a vacuum printer, developed with a 5.26% aqueous solution of sodium silicate having an $SiO_2/Na_2O$ ratio of 1.74 (pH 12.7), and gummed up with a gum arabic aqueous solution having a specific gravity of 14° Bacu/e/ . The resulting printing plate was used for printing in the aforesaid manner, and the results obtained are shown in Table 5.

COMPARATIVE EXAMPLE 10

Comparative Support 10 was prepared in the same manner as described in Example 13, except that the electrochemical graining and the subsequent desmut treatment were not conducted.

A lithographic printing plate was produced using Comparative Support 10 in the same manner as in Example 13, and the printing plate was used for printing in the aforesaid manner. The results obtained are shown in Table 5.

COMPARATIVE EXAMPLE 11

Comparative Support 11 was prepared in the same manner as for Comparative Support 9 of Comparative Example 9, except that the treatment with a sodium silicate aqueous solution was not conducted.

A lithographic printing plate was produced from Comparative Support 11 in the same manner as in Example 13, and the printing plate was used for printing in the aforesaid manner. The results obtained are shown in Table 5 below.

TABLE 5

| | Example 13 | Comparative Example 10 | Comparative Example 11 |
|---|---|---|---|
| Support | 13 | 10 | 11 |
| Processing Solution in Chemical Graining | 15% of HCl, 87%* of $AlCl_3$ (ca. 15%)** | 15% of HCl, 87%* of $AlCl_3$ (ca. 15%) | brush graining, followed by chemical graining; 10% of HCl, saturation concn. of $AlCl_3$ |
| Brush Graining | not conducted | not conducted | |
| Electro-chemical Graining | conducted | not conducted | not conducted |
| Light-Sensitive Layer | positive | positive | positive |
| Stains in Non-Image Areas*** | A | A | B |
| Press Life | 100,000 prints | 80,000 prints | 60,000 prints |

Note:
*Concentration with respect to a saturation concentration.
**Concentration based on the aqueous solution.
***A No stain was formed even under varying amount of dampening water provided on a printing press
B Stains were formed with a slight variation of amount of dampening water From the results of Table 5, it is apparent that Support 13 prepared by the process of the present invention provides a lithographic printing plate having long press life as compared with Comparative Support 10, and being superior in press life and less susceptible to stain formation as compared with Comparative Support 11.

While the invention has been described in detail with reference to specific embodiments thereof, it will be apparent to one skilled in the art that various changes and modifications can be made therein without departing from the spirit and scope thereof.

What is claimed is:

1. A process for producing an aluminum support for a lithographic printing plate, comprising chemical graining of at least one side of an aluminum plate with an etching solution so as to form an average center-line roughness of from 0.3 to 1.3 μm, wherein the etching solution is an aqueous solution containing a mineral acid and from 40 to 95% by weight with respect to the saturation concentration of the mineral acid an unsaturated concentration of an aluminum salt of a mineral acid.

2. A process as in claim 1, wherein the process further includes anodic oxidation of the chemically grained aluminum plate.

3. A process as in claim 1, wherein the process further includes electrochemical graining of the chemically grained aluminum plate.

4. A process as in claim 3, wherein the electrochemical graining is carried out in an electrolytic solution comprising nitric acid, hydrochloric acid, or a combination thereof, by using alternating current.

5. A process as in claim 1, wherein the process further includes electrochemical graining of the chemically grained aluminum plate, and anodic oxidation of the electrochemically grained aluminum plate.

6. A process as in claim 1, wherein the process further includes chemical desmutting of the chemically grained aluminum plate and electrochemical graining of the chemically desmutted aluminum plate.

7. A process as in claim 1, wherein the mineral acid is present at a concentration of from 6 to 20% by weight.

8. A process as in claim 7, wherein the mineral acid is present at a concentration of from 10 to 15% by weight.

9. A process as in claim 1, wherein the aluminum salt of a mineral acid is present at a concentration of from 70 to 95% by weight with respect to a saturation concentration.

10. A lithographic support prepared by the process of claim 1.

11. A lithographic support prepared by the process of claim 2.

12. A lithographic support prepared by the process of claim 4.

13. A process as in claim 1, wherein the mineral acid is selected from the group consisting of hydrochloric acid, sulfuric acid, phosphoric acid, boric acid and nitric acid.

14. A process as in claim 1, wherein the aluminum salt of mineral acid is selected from the aluminum salts of hydrochloric acid, sulfuric acid, phosphoric acid, boric acid and nitric acid.

* * * * *